US007837531B2

(12) United States Patent
Friedland et al.

(10) Patent No.: US 7,837,531 B2
(45) Date of Patent: Nov. 23, 2010

(54) TOY DOLL

(76) Inventors: Les Friedland, 37 Mohawk Ave., Oceanport, NJ (US) 07757; Phillip Wong, No. 9 Lai Yip Street, 4th Floor Tung Lee Industrial Building, Kwun Tong, Kowloon (CN)

( * ) Notice: Subject to any disclaimer, the term of this patent is extended or adjusted under 35 U.S.C. 154(b) by 1198 days.

(21) Appl. No.: 11/262,642

(22) Filed: Oct. 31, 2005

(65) Prior Publication Data

US 2007/0099538 A1 May 3, 2007

(51) Int. Cl.
*A63H 3/20* (2006.01)
*A63H 3/28* (2006.01)
*A63H 3/48* (2006.01)

(52) U.S. Cl. ..... 446/298; 446/301; 446/337; 446/342

(58) Field of Classification Search ..... 446/297, 446/298, 299, 300, 301, 337, 342
See application file for complete search history.

(56) References Cited

U.S. PATENT DOCUMENTS

| | | | | |
|---|---|---|---|---|
| 3,828,469 | A * | 8/1974 | Giroud | 446/337 |
| 4,900,289 | A * | 2/1990 | May et al. | 446/342 |
| 5,415,579 | A * | 5/1995 | Pracas | 446/295 |
| 5,975,979 | A * | 11/1999 | Ferri Llorens | 446/301 |
| 6,599,166 | B2 * | 7/2003 | Ellman et al. | 446/300 |
| 6,685,530 | B1 * | 2/2004 | Rehkemper et al. | 446/175 |
| 6,988,928 | B2 * | 1/2006 | Willett | 446/330 |

* cited by examiner

*Primary Examiner*—John Ricci
(74) *Attorney, Agent, or Firm*—Tutunjian & Bitetto, P.C.

(57) ABSTRACT

An interactive toy doll is described for performing and displaying realistic facial expressions and ordered sequences of visual and aural effects upon activation. The doll includes at least one sensor disposed thereon, a position orientation switch, at least one motor and at least one pair of contact switches functionally connected with a controller. Upon initial activation of a sensor, the doll is responsive to subsequent re-orientation thereafter for a pre-determined amount of time.

15 Claims, 9 Drawing Sheets

TOY DOLL

BACKGROUND OF THE INVENTION

1. Technical Field of the Invention

The present invention relates generally to toy dolls, and in particular, to an interactive toy doll and method for interacting with and operating same.

2. Description of Related Art

In the art, toy dolls in a variety of styles, shapes, features and characteristics are known. In particular, dolls that are mechanized and exhibit action features such as movement and motion such as limb/hand movements, 'wetting' diapers, as well as sound effects are familiar in the art.

Such mechanized dolls typically are switch activated, whereupon the particular action(s) or movement(s) is performed upon activation of a switch, which itself may be activated in a number of ways. Typically, in such dolls, the switch is manually activated by a user.

However, upon execution and completion of the particular movement(s), the doll becomes sedentary once more. Such a toy's entertainment value is often limited, since any 'interaction' with the toy is simply reduced to a user simply activating and re-activating the switch repeatedly. A child's interest often quickly disappears in a short period of time with such toys.

In addition, the movement of many mechanical dolls fail to mimic natural movements; for example, realistic and accurate facial expressions are especially difficult to emulate.

Accordingly, a toy doll which captures and maintains user interest, provides a stimulating interactive experience for the user, exhibits realistic expressions and movements and encourages continued play, is highly desirable.

SUMMARY OF THE INVENTION

The present invention is directed to an interactive toy doll for performing and displaying ordered sequences of visual and aural effects, including realistic facial expressions upon initial activation. The doll includes at least one sensor disposed thereon, a position orientation switch, at least one motor and at least one pair of contact switches functionally connected with a controller. Upon initial activation of a sensor, the doll is preferably responsive to, e.g., subsequent re-orientation/re-positioning thereafter for a pre-determined amount of time.

According to an aspect of the present invention, a toy doll is provided comprising a head shell for housing at least a movable eyelid piece and a movable jaw piece and at least one motor for powering said movable eyelid and jaw pieces. A flexible sheath is provided for covering an external portion of said shell, wherein the sheath is attached to the eyelid and jaw pieces.

According to another aspect of the present invention, a method of operating an interactive toy doll is provided comprising the steps of activating a sensor switch, determining if the doll is in an upright position, wherein if yes, further comprising activating a first action sequence, and wherein if no, activating a second action sequence. Next, it is determined if the doll has been re-positioned, wherein if yes, it is further determined if the time elapsed from said activating step is greater than about X minutes.

According to yet another aspect of the present invention, a toy doll is provided comprising a hollow head shell for housing at least a movable eyelid piece having a first protrusion, and a movable jaw piece having an engagement point; a first and a second rotating guide each including a curved groove, wherein said first protrusion is slidably received in the curved groove of said first guide and the engagement point is slidably received in the curved groove of the second guide; at least one motor for powering said first and second rotating guides, wherein movement of said first and second guides causes movement of said eyelid and jaw pieces; and a controller for controlling operations of the doll. A flexible sheath is provided for covering an external portion of said shell, wherein the sheath is attached to the eyelid and jaw pieces.

These and other aspects, features, and advantages of the present invention will be described or become apparent from the following detailed description of the preferred embodiments, which is to be read in connection with the accompanying drawings.

BRIEF DESCRIPTION OF THE DRAWINGS

This disclosure will present in detail the following description of preferred embodiments with reference to the following figures wherein.

DETAILED DESCRIPTION OF PREFERRED EMBODIMENTS

Figure 1:
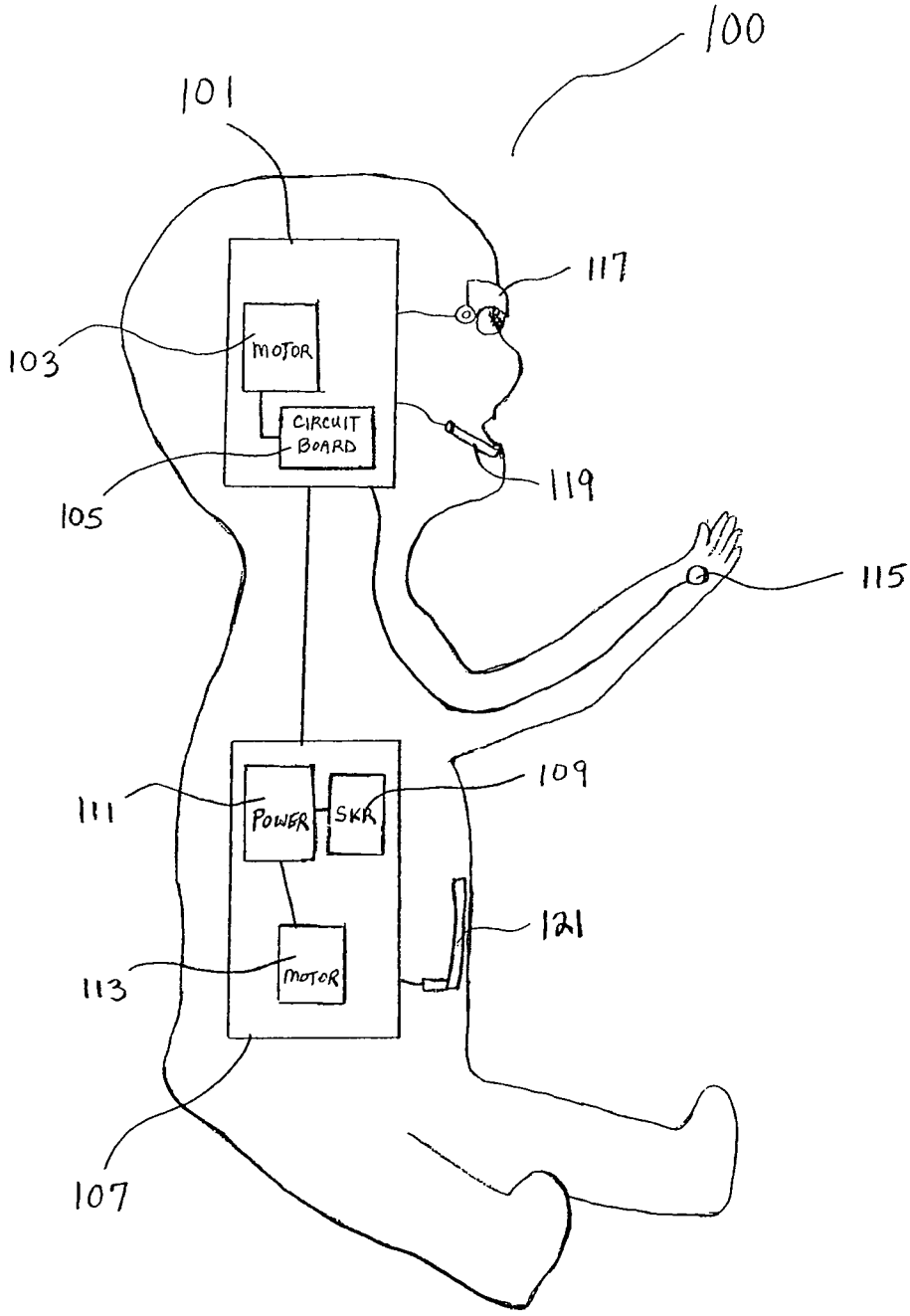
FIG. 1 is a schematic view of general electrical and mechanical components of a doll according to an aspect of the present invention.

FIG. 1 depicts an exemplary schematic view of general electrical and mechanical components of a doll 100 according to an aspect of the present invention. The doll 100 includes a first control center 101 functionally connected to a second control center 107. First control center 101 includes a motor 103 operably connected to a controller or circuit board 105. Motor 103 may drive, e.g., mechanical movements of the doll's eyes and mouth via e.g., a system of gears, pulleys, etc. which are controlled by the circuit board 105. The second control center 113 may also include a motor 113 for generating additional movements, e.g., movements of the doll's torso (simulating breathing), and limbs.

Movements/sound performed by the doll may be elicited via activation of a sensor/switch 115, which may be located anywhere on the doll. The doll includes a speaker 109 for sound projection capabilities. A power source 111 is provided functionally connected to and energizes both control centers 101 and 107.

In one embodiment, a rotatable eyelid piece 117, a movable jaw piece 119 and/or a movable torso piece may be provided which are functionally connected to control centers 101 and/or 107. Desirable movement of the pieces 117, 119 and/or 121 (e.g., in vertical and/or horizontal directions) may be facilitated via gears which may be prompted to reverse direction of rotation, which in turn reverses the direction of movement (up or down) of pieces 117 and 119. Such gear reversal capability may be facilitated via, e.g., a system of contact switches which may be physically activated (e.g., during operation of the doll) so as to complete/close certain circuits, one of which may direct the rotation of the gears in a first direction, and another which may direct the gear rotation in the opposite direction. Accordingly, the effect of eyelid and mouth movements (opening and closing) as well as respiration (torso expanding and contracting) may be simulated. Other motor-driven or movable pieces may be provided and situated on the doll 100 in any location for facilitating, e.g., other body movements and actions.

Figure 2:
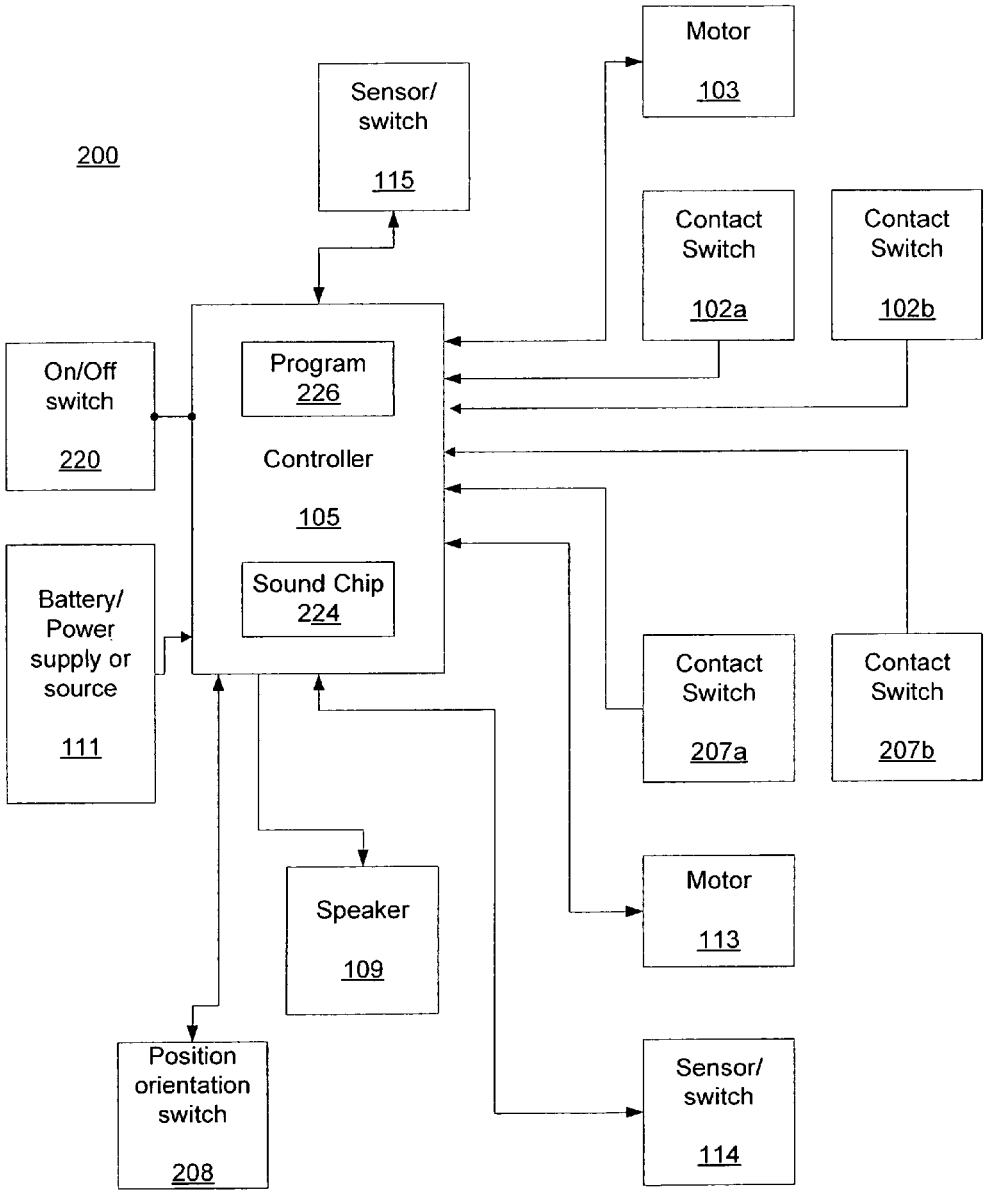
FIG. 2 is a schematic block diagram of an electrical system according to an aspect of the present invention.

Referring to FIG. 2, a block diagram showing an electrical system 200 in accordance with one illustrative embodiment is shown. System 200 includes the controller 105, which is employed to control operations of the doll in response to the internal and external inputs.

In one embodiment, controller 105 includes a printed wiring board, which may include one or more integrated circuits, transistors and/or logic circuits to perform the tasks as described herein. Controller 105 drives motors 104 and 105 using a power source 111 (e.g., a battery/batteries or other portable energy source). Power may be switched on and off via a switch 220. Motors 103 and 113 may include, e.g., simple DC powered motors that rotate in accordance with the voltage polarity applied thereto. For example, motors may turn clockwise in accordance with a +3 volt signal and counterclockwise in accordance with a −3 volt signals. Other voltages may be employed depending on the available battery power.

Motors 103 and 113 may be activated in accordance with a plurality of different signals. In one embodiment, motors 103 and 113 are activated in accordance with a sensor/switch 115. Sensor/switch 115 may include a normally open switch located in any area of the doll (e.g., a hand, foot, torso, head, etc.). More than one switch 115, 114 may be provided on the doll, at any location thereon.

When closed by, e.g., squeezing or touching a body part of the doll, the sensor/switch 115 may prompt controller 105 to activate e.g., one or more action modes (e.g., a 'sleep' mode, an 'awake' mode, etc.). For example, the controller 105 may turn on one or more motors 101, 113 and/or a sound chip 224 and the speaker 109 to perform one or more tasks for simulating, e.g., a particular action mode. These tasks may include, for example, moving arms of the doll, moving the dolls eye lids and/or mouth, causing a crying effect, causing a sleeping effect/simulating deep breathing, playing sounds or any other mechanical movements or sounds to further simulate the action mode that has been activated.

In accordance with another aspect of the present invention, a position orientation switch 208 may be provided for prompting one or more of motors 103, 113 and/or a speaker 109 to be activated. Position orientation switch 208 functions in a similar way, e.g., as a mercury switch. When a doll is positioned in a particular orientation (e.g., a reclined position, upright position, etc.), the switch is closed, and when the doll is thereafter positioned in a different orientation the switch is opened.

For example, if the doll is held upright and the sensor switch 115 is activated, the doll begins to exhibit movement/sound in accordance with a pre-programmed sequence matched to that particular position (e.g., the doll will play corresponding samples recorded on a sound chip 124 and display certain pre-programmed movements). If the doll's position is changed, say to a prone or reclined position, the position orientation switch 208 is closed (for example, by the flow of a conductive fluid in a sealed cavity), and the doll activates controller 105 in accordance with instructions or logic in a program chip 226 to activate motors 103 and/or 113 and/or cause sound chip 224 to noises simulating deep breathing, snoring, etc. Any positioning of the doll may be contemplated for activating the position orientation switch 208, including but not limited to a face-down position, sideways positions, and any position in between a fully upright and completely reclined position.

In one embodiment, an activated motor 113 is powered via controller 105 causing the torso piece 121 in the abdomen of the doll to move outwards away from the doll until a contact switch 207*a* is closed by the motion of the torso piece 121. That is, when the torso piece 121 moves a certain pre-determined distance, the contact switch 207*a* is closed. The closed circuit causes the controller 105 to reverse the polarity of the motor 113 to reverse its motion. The reverse motion causes the torso piece 121 to reverse direction until a second contact switch 207*b* is closed, which reverses the motion of motor 113 and thus the torso piece 121. This is repeated, e.g., for an amount of time determined by program chip or logic 226.

Motor 103 and contact switches 206*a* and 206*b* may function in a similar way to cause, e.g., the doll's eyelids to open and close and/or cause movement in the doll's mouth and cheeks to simulate eating, talking, sucking or to simulate facial expressions. The motion between contact switches 206*a* and 206*b* may include/incorporate the up and down motion of the doll's eyes or mouth. For example, when the motion to close the eyes is complete, contact switch 206*a* is caused to close causing the controller 105 to reverse the polarity of motor 103, thus causing the eyes to open again until contact switch 206*b* is closed. This is repeated until, e.g., an elapsed amount of time or number of iterations has been reached as determined by program chip 226.

Figure 3:
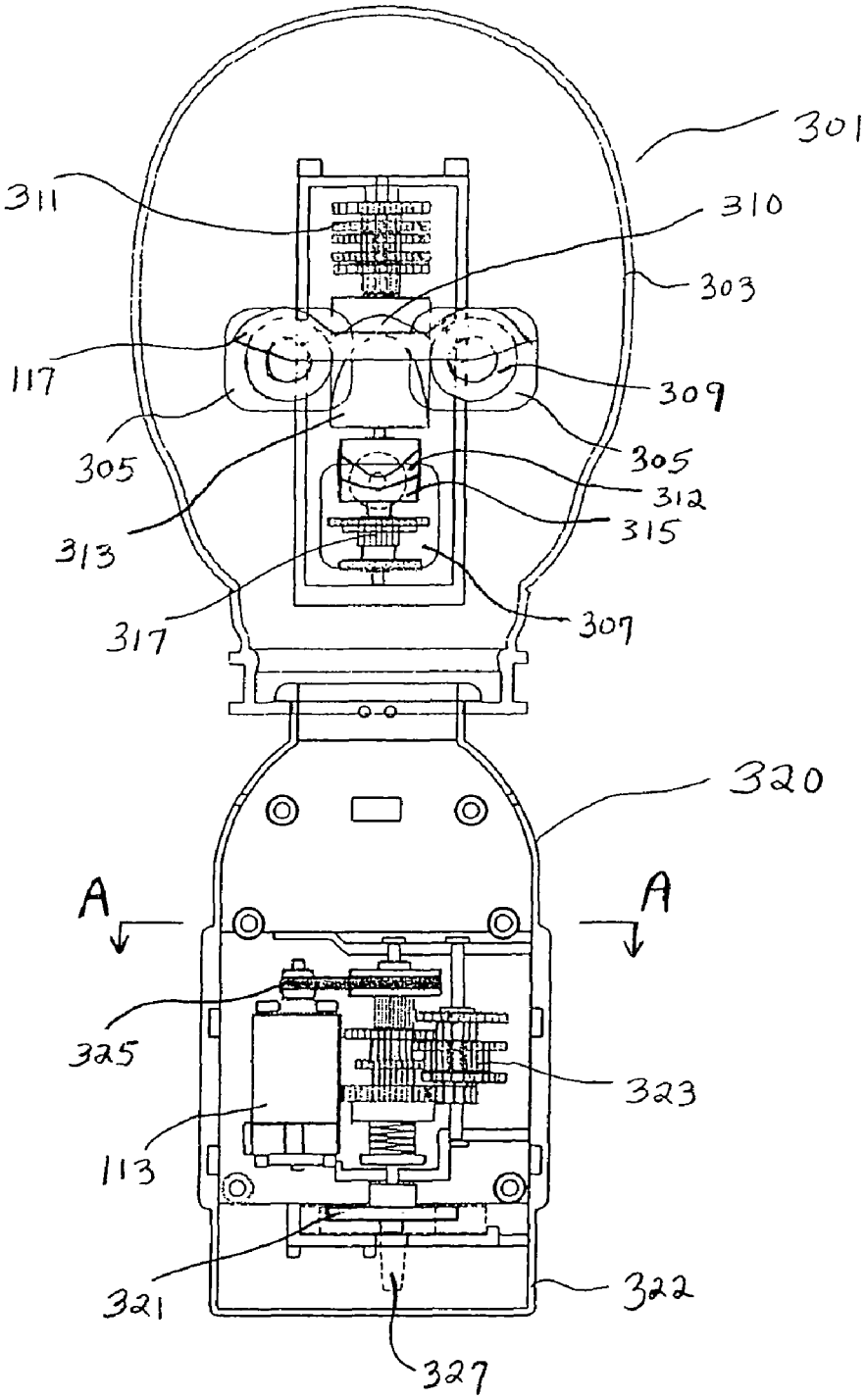
FIG. 3 is a front view of internal mechanical components of a doll assembly according to an aspect of the present invention.
Figure 4:
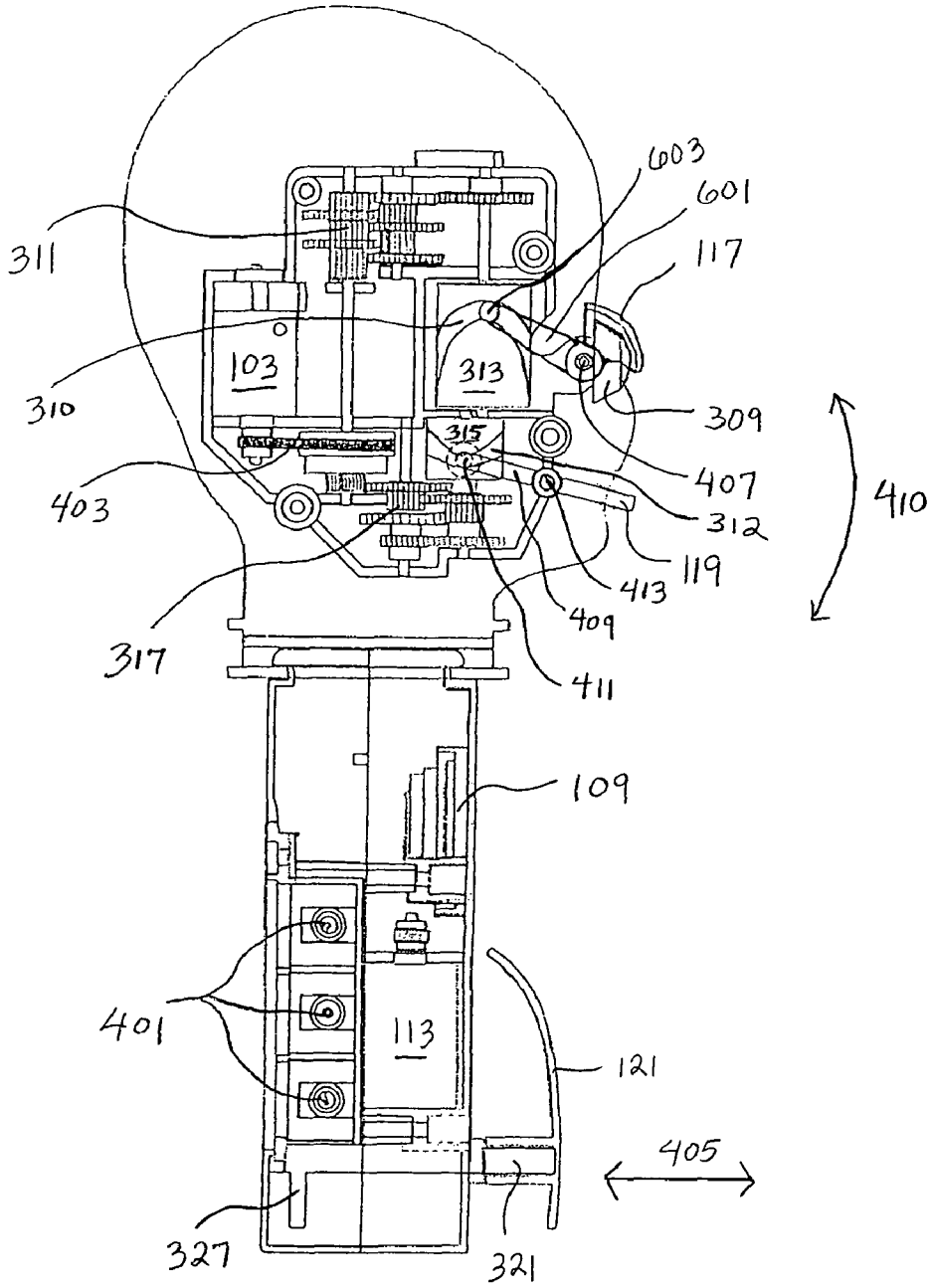
FIG. 4 is a side view of FIG. 3.
Figure 5:
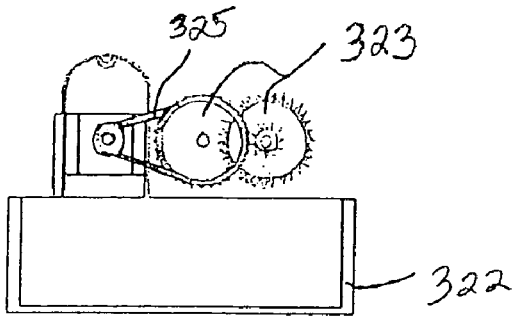
FIG. 5 is a cross-sectional view taken along lines A-A of FIG. 3.

FIGS. 3-5 are various views of internal mechanical components of a doll assembly according to an aspect of the present invention. The mechanical assembly includes a head 301 connected with body 320, the head comprising a hollow shell 303 having eye apertures 305 through which eyeballs 309 protrude, and mouth aperture 307, all shaped and sized accordingly.

A covering may be provided over the shell 303 and housing 323 comprised, e.g., of molded rubber or other preferably flexible materials for simulating features of e.g., an infant head, body parts, etc. Any type or combination of materials, e.g., foam, rubber, plastic, etc., may be utilized as desired to cover shell 303 and housing 323 and form the shape of the doll 100. It is to be noted that while a toy doll according to the present invention is described and shown here as a human infant, other doll types may be contemplated, including animals, cartoon characters, fictional characters, robotic devices, household appliances, vehicles, airplanes, etc.

Figure 6:
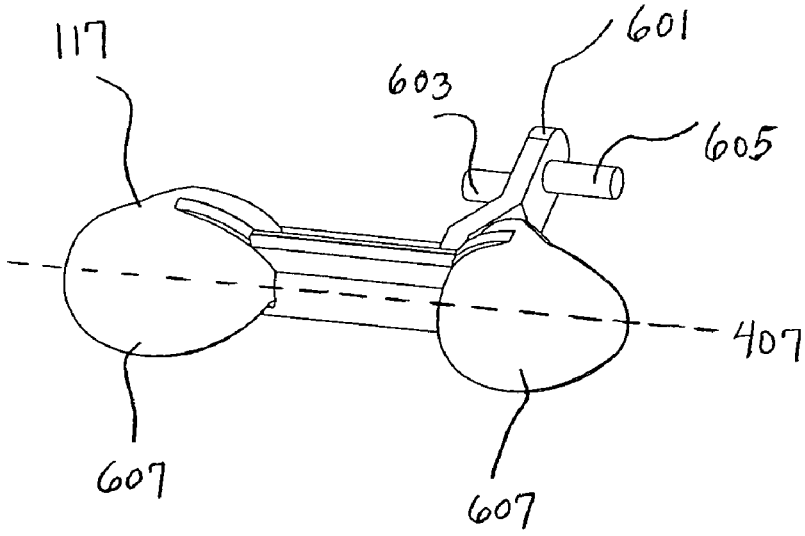
FIG. 6 is a perspective view of an eyelid piece according to an aspect of the present invention.

The eyelid piece 117 is positioned over the eyeballs 309 and movement of same is effectuated via e.g., a pulley 403, a system of gears 311 and a rotating guide 313 powered by motor 103. The visual effect of eyes which are 'opening and closing' may be simulated via movement of the eyelid piece 117 rotating on its axis 407 upon movement of pivot arm 601 which is connected onto the eyelid piece 117 as shown, e.g., in FIG. 6.

The pivot arm 601 is movably connected to the rotating guide 315 via e.g., a first protrusion 603, which is slidably received within a curved groove 310 of the rotating guide 313. Thus, the movement of gears 311 turn the rotating guide 313, which moves the pivot arm 601, thus causing rotation about axis 407 and movement of the eyelid piece 117. The contact switches 206*a* and 206*b* may be repeatedly contacted, and thus activated, in an alternating fashion by a second protrusion 605 provided on the pivot arm 601. This causes an up and down motion of the eyelid piece 117 (e.g., in direction 410). The contact switches 206*a* and 206*b* may be located in any location on the head 301, preferably in proximity to second protrusion 605.

Movement of the jaw piece 119 is effectuated via movement of e.g., gears 317 which drive a second rotating guide 315 powered by the motor 103. The second rotating guide 315 includes a curved cavity 312. The jaw piece 119 is movably connected to the second rotating guide 315 via an engagement point 411 on an arm 409. The engagement point 411 is slidably received within the curved groove 312. Rotation of the second rotating guide 315 causes the engagement point 411 to slide within groove 312, thus causing jaw piece 117 to rotate about its pivot point 413. Ultimately, jaw piece 119 is caused to be moved up and down (e.g., in direction 410).

As the eyelid 117 and jaw piece 119 movements occur, they cause corresponding areas of the external flexible covering layer (e.g., rubber face) which lie over the eyelid/jaw pieces to move accordingly, thus simulating facial features, such as sucking, talking, blinking, etc. (explained further with reference to FIG. 10). Movement of other parts of the face such as cheeks, eyebrows, etc., may be facilitated by altering the location/configuration of the mechanical parts accordingly. Facial expressions and movement configuration may be accompanied by appropriate sounds and body movements as controlled by the controller. For example, a sleepy or sleeping expression may be accompanied by speaker sounds of snoring and slower movement of limbs.

The body 320 includes a housing 322 which houses the motor 113 for driving gears 323 and pulley 325, which cause a plate 321 and tab 327 to be moved, e.g., in an up and down motion 405 relative to the body 320. The torso piece 121 is affixed onto the plate 321; accordingly, movement of the plate 321 causes movement, in turn, of the torso piece 121. The contact switches 207*a* and 207*b* may be repeatedly contacted (and thus activated) in an alternating fashion by movement of the tab 327 back and forth. This causes, e.g., expansion/contraction of the doll's stomach/torso area to simulate breathing action in the doll.

Figure 9:
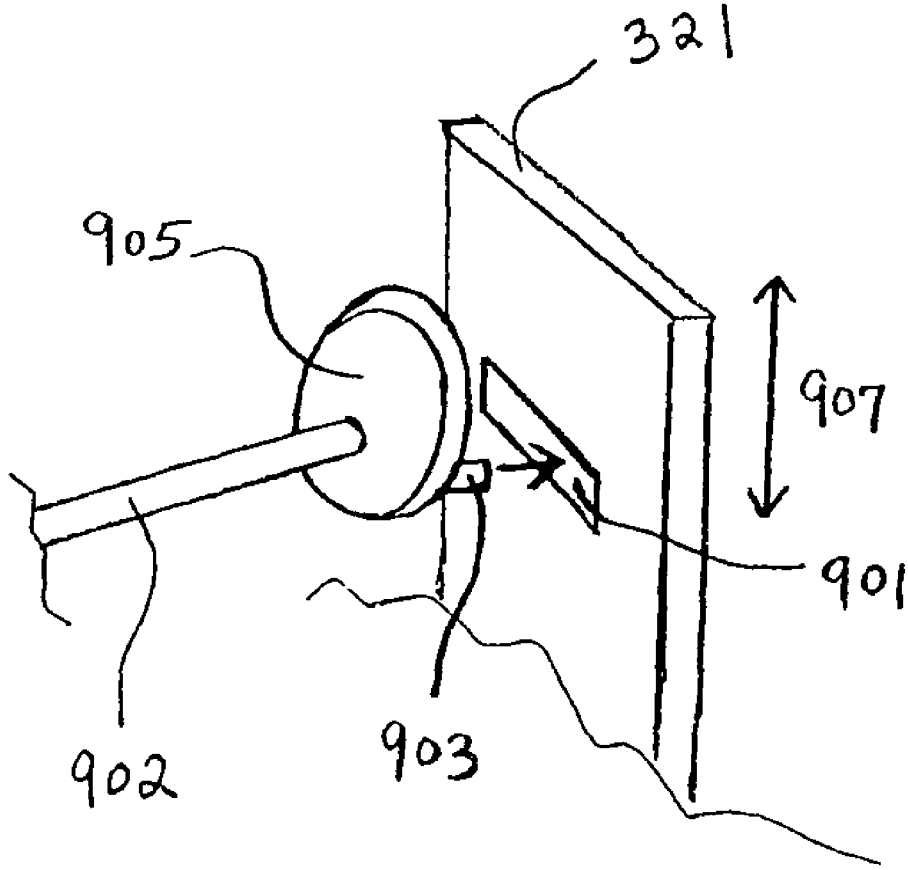
FIG. 9 is an exploded view of exemplary components of a mechanical assembly for effectuating torso movement according to an aspect of the present invention.

Movement of the plate 321 (and thus simulation of torso movement) may be effectuated via a mechanical assembly as shown e.g., in FIG. 9. An axle 902 includes a wheel 905 fixedly attached at one end thereon. The wheel 905 includes a rod 903 fixedly attached at an outer surface thereof. The plate 321 includes a slot 901 into which the rod 903 is slidably received. Rotation of the wheel 905 causes rod 903 to slide within slot 901, thus forcing movement of the plate 321 back and forth in direction 907 as wheel 905 is continuously rotated.

A power supply may be provided in the form of batteries 401. Speaker 109 may be provided for sound projection.

FIG. 5 is a view looking down upon lines A-A of FIG. 3, showing a top view of pulley system 325 and gears 323.

Figure 7:
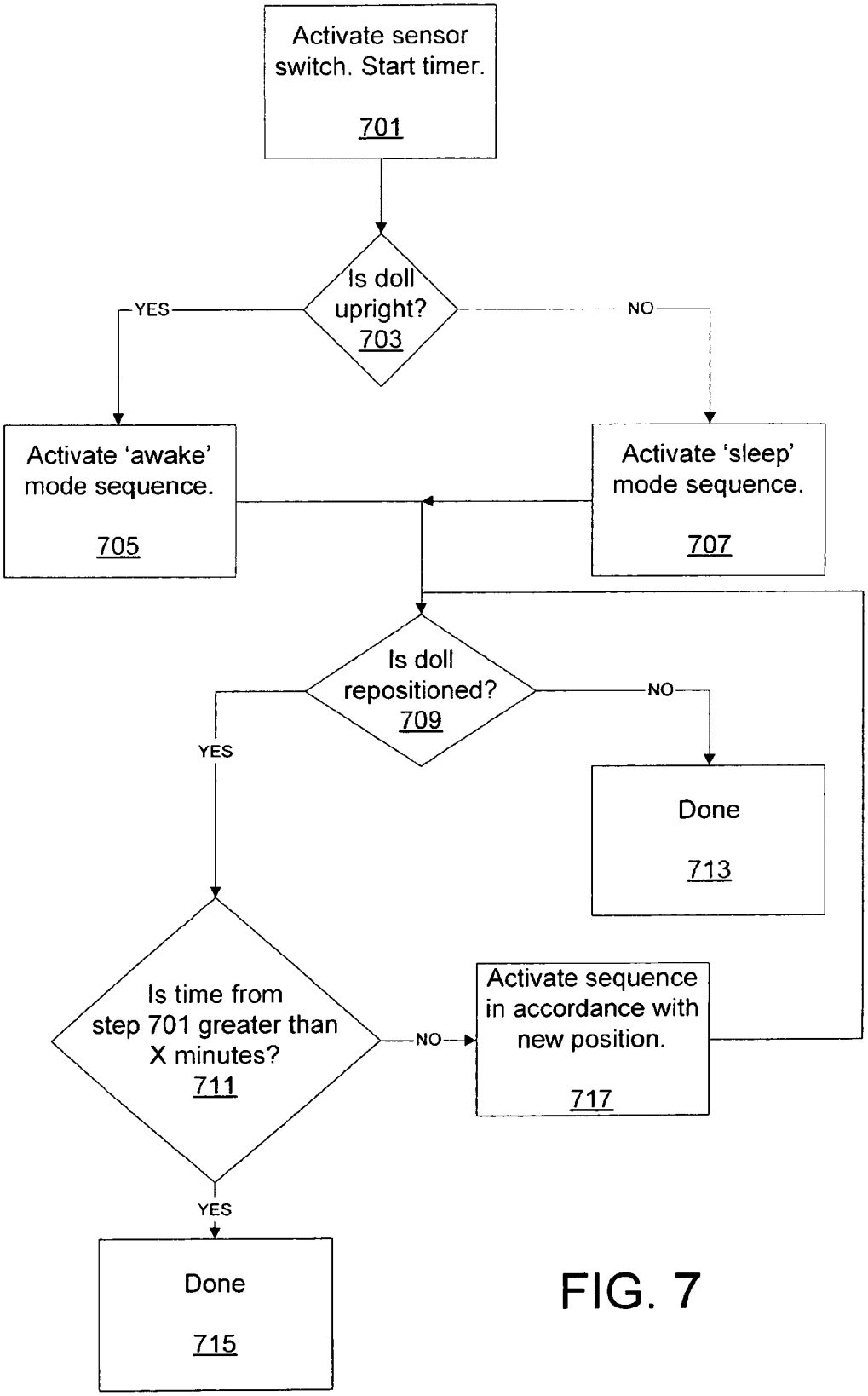
FIG. 7 is a flow chart of an exemplary method of operation of a toy doll according to an aspect of the present invention.

FIG. 7 depicts an exemplary flow chart 700 of a method of interacting with a doll according to one embodiment of the present invention. Upon activation/deployment of a sensor switch (step 701), for example, pressing a part of the doll's body which has the sensor switch, a timer is started and the system ascertains whether the doll is in an upright position (step 703).

If yes, an 'awake' mode sequence is activated, and a pre-programmed sequence of movements/sounds imitating, e.g., a baby which is awake, are activated accordingly. If no, a 'sleep' mode sequence is activated, in which a pre-programmed sequence of movements/sounds relating to, e.g., a sleeping baby is activated.

The system proceeds to step 709, which determines if the doll has been re-positioned. If yes, it is determined if the time elapsed from step 701 is greater than about X number of minutes. The number of minutes may be pre-programmed as desired by the manufacturer and/or user, and may comprise e.g., about 5 minutes. If it is determined that the doll has not been re-positioned within the allotted amount of time, the system is done (step 713).

If greater than X minutes has not elapsed, an action sequence (e.g., 'awake' or 'sleep' mode) is activated corresponding to the doll's new position (step 717). The system proceeds then to step 709. If greater than about X minutes or other set time (e.g., 2 minutes) has elapsed, the system is done (step 715).

Figure 8:
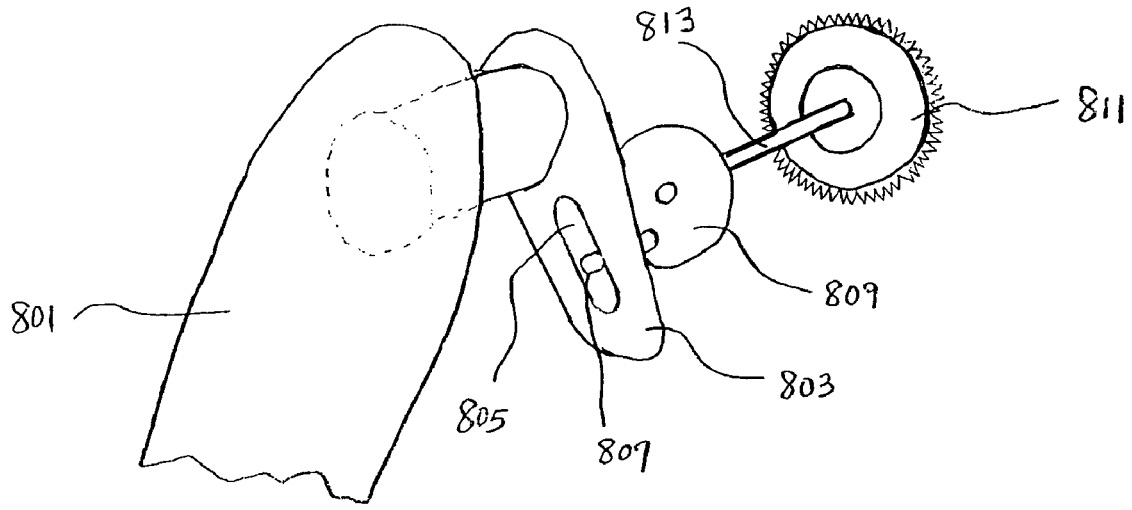
FIG. 8 is a perspective view of mechanical components for effectuating limb movement according to an aspect of the present invention.

According to another embodiment of the present invention, a doll may be provided which may perform movements/functions in addition to or instead of the above-mentioned functions. For example, a doll may be provided which may perform the above-mentioned facial movements and may further perform limb movements (arms and/or legs). Such limb movement may be enabled via a configuration as shown in FIG. 8, in which a limb 801 includes a slotted member 803 fixedly attached thereon, the limb 801 being rotatably held within a socket. A gear train assembly 811 is provided including an axle 813 on which a wheel 809 is fixedly attached at one end. The wheel 809 includes a rod 807 attached on an outer surface. The slotted member includes a slot 805 which slidably receives the rod 807 from wheel 809. Rotation of the gear train 811 causes rotation of the axle 813, wheel 809 and rod 807. The rod 807 is caused to be slidably moved within slot 805, thus resulting in movement of the limb 801.

Figure 10:
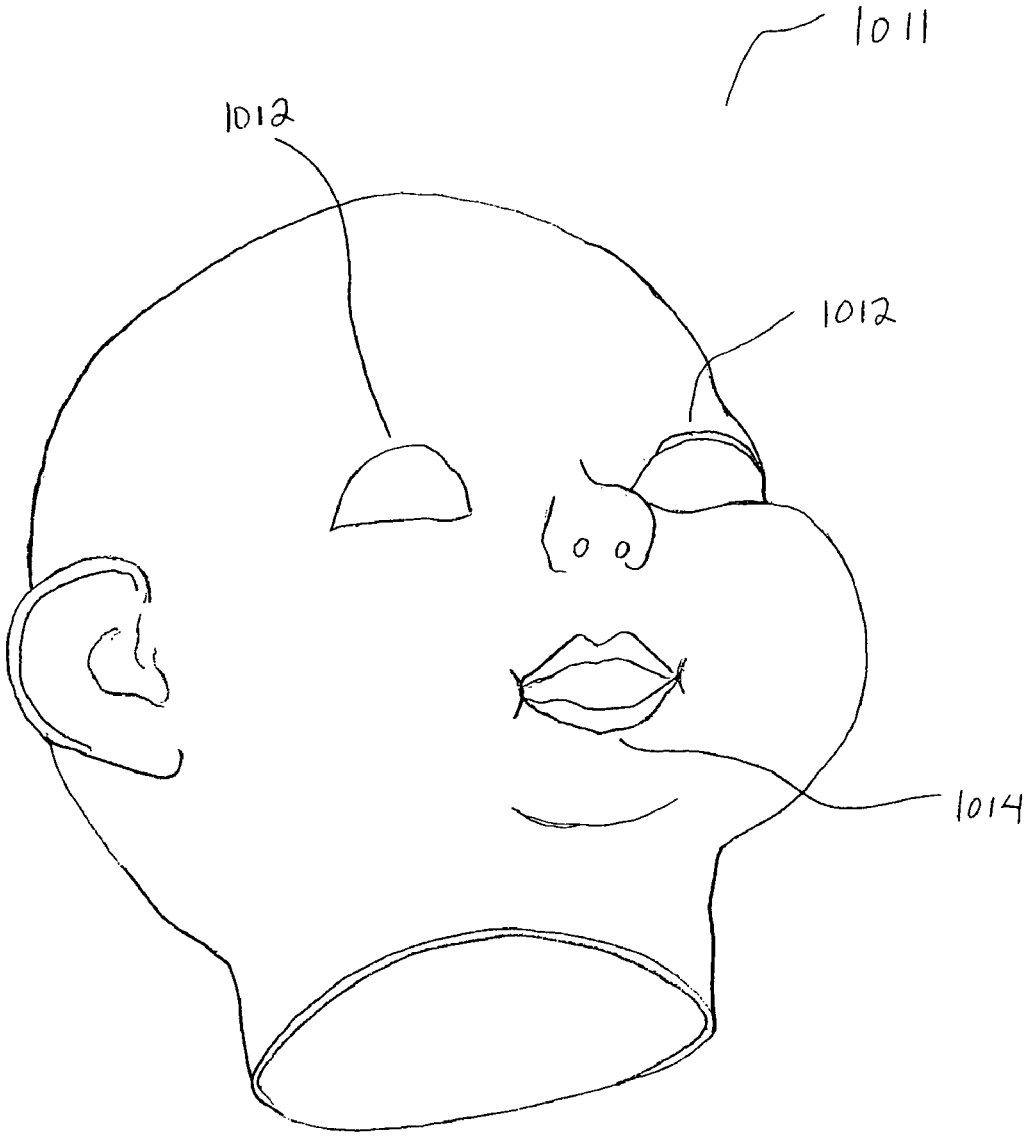
FIG. 10 is an exemplary external covering according to an aspect of the present invention.

An exemplary external covering or sheath 1011 is shown in FIG. 10, shaped in the form of an infant's face. Preferably, the covering is comprised of a highly flexible, pliable and resilient material (e.g., rubber, rubber composites, plastic, silicone, etc.), with a thickness no greater than about 0.20 cm.

The underlying movable mechanical parts of the doll assembly are preferably arranged in appropriate locations. For example, in the case of providing a doll with movable eyes and mouth, the movable eyelids 117 and jaw piece 119 are provided as shown e.g., in FIGS. 3 and 4, and the sheath 1001 is then placed over the shell 303. A tip 607 of each eyelid piece 117 is secured (glued) underneath each top eyelid 1012 of the sheath. The jaw piece 119 is preferably attached (glued) to a lower lip 1014 of the sheath 1011. Otherwise, the sheath 1011 is preferably free of any other points of attachment to the shell 303 to enable free movement otherwise. Accordingly, when the eyelids 117 and jaw piece 119 move, the attached top eyelids 1012 and lower lip 1014 of the sheath 1011 move in conjunction, and thus result in the simulation of facial expressions.

Advantageously, the sheath's 1011 material qualities, thickness and mode of attachment enable a realistic effect of facial movements. A wide array of movements (e.g., movable ears, eyebrows, etc.) can be simulated with alteration of points of attachment and mechanical parts as necessary.

Having described preferred embodiments for an interactive toy doll (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A toy doll comprising:

a head shell for housing at least a movable eyelid piece and a movable jaw piece; and at least one motor for powering said movable eyelid and jaw pieces to cause facial movement and expressions;

a flexible sheath for covering an external portion of said shell, wherein the sheath is attached to the eyelid and jaw pieces;

a switch, wherein said at least one motor is activated in accordance with the switch; and a controller functionally attached to the motor and the switch for controlling operations of the doll, wherein the controller includes a position orientation sensor which is activated in accordance with re-positioning of the doll, wherein the position orientation sensor is activated when the doll is re-positioned within a time X after initial activation of the switch.

2. The toy doll of claim 1, wherein points of attachment of the sheath include the eyelid and jaw pieces.

3. The toy doll of claim 1, wherein the time X comprises about 2 minutes.

4. The toy doll of claim 1, further comprising a body attached to said head shell, the body comprising:

at least one body motor functionally connected to the controller; and a movable member functionally connected to the body motor and to limbs of the doll, such that the member provides movement of the limbs in accordance with the controller.

5. The toy doll of claim 1, wherein the flexible sheath is displaced when the at least one motor is in operation to cause a change in facial expression of the doll.

6. The toy doll of claim 1, further comprising a speaker controlled by the controller to generate sound in accordance with a state of the doll.

7. A toy doll comprising:

a head shell for housing at least a movable eyelid piece and a movable jaw piece; and at least one motor for powering said movable eyelid and jaw pieces to cause facial movement and expressions;

a flexible sheath for covering an external portion of said shell, wherein the sheath is attached to the eyelid and jaw pieces;

a switch, wherein said at least one motor is activated in accordance with the switch;

a controller functionally attached to the motor and the switch for controlling operations of the doll; and a body attached to said head shell, the body comprising a housing including:

at least one body motor functionally connected to the controller; and a movable plate functionally connected to the body motor, the plate having a torso piece affixed thereon, wherein movement of the plate causes movement of the torso piece in a direction away from the housing.

8. A toy doll comprising:

a head shell for housing at least a movable eyelid piece and a movable jaw piece; and at least one motor for powering said movable eyelid and jaw pieces to cause facial movement and expressions;

a flexible sheath for covering an external portion of said shell, wherein the sheath is attached to the eyelid and jaw pieces;

a switch, wherein said at least one motor is activated in accordance with the switch;

a controller functionally attached to the motor and the switch for controlling operations of the doll, wherein the controller includes a position orientation sensor which is activated in accordance with re-positioning of the doll, wherein the position orientation sensor is activated when the doll is re-positioned within a time X after initial activation of the switch; and a speaker controlled by the controller to generate sound in accordance with a state of the doll, wherein the state of the doll includes a position of the doll.

9. The toy doll of claim 8, wherein the state of the doll is dependent on the facial movement and expressions.

10. The toy doll of claim 8, further comprising a body attached to said head shell, the body comprising:

at least one body motor functionally connected to the controller; and a movable member functionally connected to the body motor and to limbs of the doll, such that the member provides movement of the limbs in accordance with the controller.

11. A method of operating an interactive toy doll, comprising the steps of:

activating a sensor switch;

determining if the doll is in a first position;

if in a first position yes, activating a first action sequence;

if the doll is in a second position, activating a second action sequence;

determining if the doll is re-positioned; and if repositioned, determining if a time elapsed from said activating step is greater than a set time.

12. The method as recited in claim 11, wherein the first position includes an upright position.

13. The method as recited in claim 11, wherein the second position includes a prone position.

14. The method as recited in claim 11, wherein if the time elapsed from said activating step is not greater than the set time, activating a second action sequence.

15. A toy doll comprising:

a hollow head shell for housing:

at least a movable eyelid piece having a first protrusion, and a movable jaw piece having an engagement point;

a first and a second rotating guide each including a curved groove, wherein said first protrusion is slidably received in the curved groove of said first guide and the engagement point is slidably received in the curved groove of the second guide;

at least one motor for powering said first and second rotating guides, wherein movement of said first and second guides causes movement of said eyelid and jaw pieces;

a controller for controlling operations of the doll; and a flexible sheath for covering an external portion of said shell, wherein the sheath is attached to the eyelid and jaw pieces, further comprising a body attached to said head shell, the body comprising a housing including:

at least one body motor functionally attached to the controller; and a movable plate functionally connected to the body motor having a torso piece affixed thereon, wherein movement of the plate causes movement of the torso piece in a direction away from the housing.

* * * * *